US010697348B1

(12) United States Patent
Lee

(10) Patent No.: US 10,697,348 B1
(45) Date of Patent: Jun. 30, 2020

(54) ENGINE COOLING SYSTEM USING A WATER PUMP AND A SOLENOID VALVE

(71) Applicants: HYUNDAI MOTOR COMPANY, Seoul (KR); KIA MOTORS CORPORATION, Seoul (KR)

(72) Inventor: Hyo-Jo Lee, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/447,278

(22) Filed: Jun. 20, 2019

(30) Foreign Application Priority Data

Dec. 6, 2018 (KR) ..... 10-2018-0156338

(51) Int. Cl.

| | |
|---|---|
| ***F01P 7/14*** | (2006.01) |
| ***F04D 13/06*** | (2006.01) |
| *F01P 5/12* | (2006.01) |
| *F01P 7/16* | (2006.01) |
| *F01P 3/02* | (2006.01) |

(52) U.S. Cl.
CPC ..... *F01P 7/14* (2013.01); *F04D 13/06* (2013.01); *F01P 3/02* (2013.01); *F01P 5/12* (2013.01); *F01P 7/16* (2013.01); *F01P 2007/146* (2013.01)

(58) Field of Classification Search
CPC ..... F01P 2007/146; F01P 3/20; F01P 5/10; F16K 31/0651; F16K 3/34; F16K 27/029
See application file for complete search history.

(56) References Cited

U.S. PATENT DOCUMENTS

| | | | | |
|---|---|---|---|---|
| 4,319,547 | A * | 3/1982 | Bierling | F01P 7/165 123/41.08 |
| 4,875,437 | A * | 10/1989 | Cook | F01P 7/167 123/41.1 |
| 6,178,956 | B1 * | 1/2001 | Steinmann | F02M 35/10222 123/568.21 |
| 2005/0028757 | A1 * | 2/2005 | Strauss | F01P 3/202 123/41.8 |
| 2012/0145804 | A1 * | 6/2012 | Ishii | B60H 1/00485 237/12.3 R |
| 2017/0037768 | A1 * | 2/2017 | Fangauer | F16K 17/048 |
| 2018/0230890 | A1 * | 8/2018 | Komuro | F16K 27/029 |
| 2019/0323413 | A1 * | 10/2019 | Lee | F04D 15/0022 |

FOREIGN PATENT DOCUMENTS

KR 101786701 B1 10/2017

* cited by examiner

*Primary Examiner* — Long T Tran
(74) *Attorney, Agent, or Firm* — Lempia Summerfield Katz LLC

(57) ABSTRACT

An engine cooling system may include: a water pump for supplying coolant to an engine system; a plurality of coolant passages for connecting the water pump to individual constituent components of the engine system; a solenoid valve disposed between an outlet of the water pump and inlets of the coolant passages to integrally control a flow of coolant from the water pump to the coolant passages; and a control unit for controlling the solenoid valve. The inlets of the respective coolant passages are adjacent to each other side by side in a width direction of the outlet of the water pump. The inlets of the respective coolant passages are sequentially opened and closed by moving a spool of the solenoid valve in the width direction.

13 Claims, 14 Drawing Sheets

ENGINE COOLING SYSTEM USING A WATER PUMP AND A SOLENOID VALVE

CROSS-REFERENCE TO RELATED APPLICATIONS

This application claims priority to Korean Patent Application No. 10-2018-0156338, filed on Dec. 6, 2018, which is incorporated herein by reference in its entirety.

BACKGROUND

Field of the Disclosure

Embodiments of the present disclosure relate to an engine cooling system; and, particularly, to an engine cooling system using a water pump and a solenoid valve.

Description of Related Art

In general, an engine cooling system for vehicles cools an engine by a water-cooling method using coolant. To this end, as disclosed in Korean Patent No. 10-1786701, a water pump is used to discharge the coolant stored in a coolant storage tank by rotating a pump impeller and to supply the coolant to the constituent components, such as a cylinder head, a cylinder block, and a radiator, of an engine in an engine system.

Examples of the water pump include a mechanical water pump that is driven in proportion to the number of revolutions of an engine and an electronically variable water pump that is electronically controllable according to the engine and environmental factors regardless of the number of revolutions of the engine. The mechanical water pump is disadvantageous in terms of fuel efficiency because it cannot be controlled in various manners according to the engine and environmental factors. On the other hand, the variable water pump is disadvantageous in terms of manufacturing costs and controllability because it uses a control mechanism with a complex structure to control the flow rate.

FIGS. 5A, 5B, and 6 illustrate a conventional variable control water pump and a cooling system using the same.

As illustrated in FIGS. 5A and 5B, in the case of the conventional variable water pump, the flow of the coolant discharged from the pump is controlled by a control unit, i.e., an engine control unit (ECU) 250. The ECU 250 controls the degree of closing of a shroud 2 using a solenoid valve 3 and a water pump slide position sensor. Accordingly, when the engine is cold, the flow of coolant is blocked for rapid warm-up as illustrated in FIG. 5A. After the warm-up, the flow of coolant is variably controlled by controlling the degree of closing the shroud 2, as illustrated in FIG. 5B.

In the cooling system illustrated in FIG. 6 using the conventional variable water pump, the coolant discharged from a coolant storage tank 500 by a water pump 100 is supplied to a cylinder head 310 and a cylinder block 320 of an engine 300.

As described above, since the mechanical pump operates in proportion to the number of revolutions of the engine, it is impossible to actively control the flow of coolant.

The conventional variable water pump can improve fuel efficiency since the flow rate is variably controllable. However, the conventional variable water pump is problematic in that, due to a complicated structure, it is difficult to secure durability and it is costly to manufacture and subjected to restricted installation space in the engine system and compartment.

Particularly, since only the flow of the coolant discharged from the water pump 100 is controllable, it is impossible to distribute the flow of the coolant discharged from the water pump 100. Accordingly, in order to separately cool the cylinder head 310 and the cylinder block 320 of the engine 300, a separate flow control valve 40, such as a thermostat, should be provided at the coolant outlet end of the engine 300.

SUMMARY

An embodiment of the present disclosure is directed to an engine cooling system capable of rapidly and accurately controlling a flow of coolant even without using an electronically variable water pump having a complicated structure. The disclosed engine cooling system is also capable of simultaneously controlling and distributing the flow of the coolant discharged from a water pump even without forming a flow distribution structure in a water pump body.

Other objects and advantages of the present disclosure can be understood by the following description and become apparent with reference to the embodiments of the present disclosure. Also, it will be apparent to those having ordinary skill in the art to which the present disclosure pertains that the objects and advantages of the present disclosure can be realized by the engine cooling system as claimed and combinations thereof.

In accordance with an embodiment of the present disclosure, an engine cooling system includes a water pump for supplying coolant to an engine system, a plurality of coolant passages for connecting the water pump to individual constituent components of the engine system, a solenoid valve disposed between an outlet of the water pump and corresponding inlets of the plurality of coolant passages to integrally control a flow of coolant from the water pump to the plurality of coolant passages, and a control unit for controlling the solenoid valve.

The inlets of the respective plurality of coolant passages may be adjacent to each other side by side in a width direction of the outlet of the water pump. The inlets of the respective plurality of coolant passages may be sequentially opened and closed by moving a spool of the solenoid valve in the width direction, thereby integrally controlling the flow of coolant from the water pump to the plurality of coolant passages.

The plurality of coolant passages may have different widths depending on the flow of coolant required to cool each component.

The plurality of coolant passages may include a first passage directed to a heater core or a low-pressure exhaust gas recirculation (LP EGR) cooler, a second passage directed to a cylinder head of an engine, and a third passage directed to a cylinder block of the engine. The inlets of the respective first, second, and third passages may be arranged so as to be opened in order of the first, second, and third passages when the spool moves in the width direction, thereby enabling the cylinder block and cylinder head of the engine to be separately cooled with ease.

In consideration of the amount of coolant required to cool each component, the widths of the first, second, and third passages may be set such that the largest amount of coolant flows to the cylinder head of the engine and the smallest amount of coolant flows to the heater core or the LP EGR cooler.

The water pump used for the engine cooling system may be a mechanical water pump or an electronically variable water pump.

When the engine is in a cold state in which the temperature of coolant is less than or equal to a first temperature, the control unit may control the solenoid valve to stop the operation of the water pump or close all the first, second, and third passages for rapid warm-up of the coolant, thereby stopping the flow of coolant in the engine system.

When the engine is in a warm state in which the temperature of coolant exceeds the first temperature and is less than or equal to a second temperature, the control unit may control the solenoid valve to first open the first passage in order to first supply the coolant to the heater core or the LP EGR cooler.

When the engine is in a high-temperature state in which the temperature of coolant exceeds the second temperature and is less than or equal to a third temperature, the control unit may control the solenoid valve to first open the first and second passages in order to increase the flow of the coolant supplied to the cylinder head.

When the engine is in a hot state in which the temperature of coolant exceeds the third temperature, the control unit may control the solenoid valve to open all the first, second, and third passages in order to supply a large amount of coolant even to the cylinder block.

When the first passage is a coolant passage directed to the LP EGR cooler, the engine cooling system may further include a flow control valve for opening and closing a coolant passage through which some of the coolant heated through the engine flows to the heater core.

When the temperature of coolant exceeds the first temperature and is less than or equal to the second temperature, the control unit may control the flow control valve such that some of the coolant heated through the engine flows to the heater core so as to be used to heat an interior of the vehicle.

The solenoid valve may be built in the outlet of the water pump in order to reduce the amount of space occupied by the water pump in the vehicle.

DESCRIPTION OF SPECIFIC EMBODIMENTS

Figure 1:
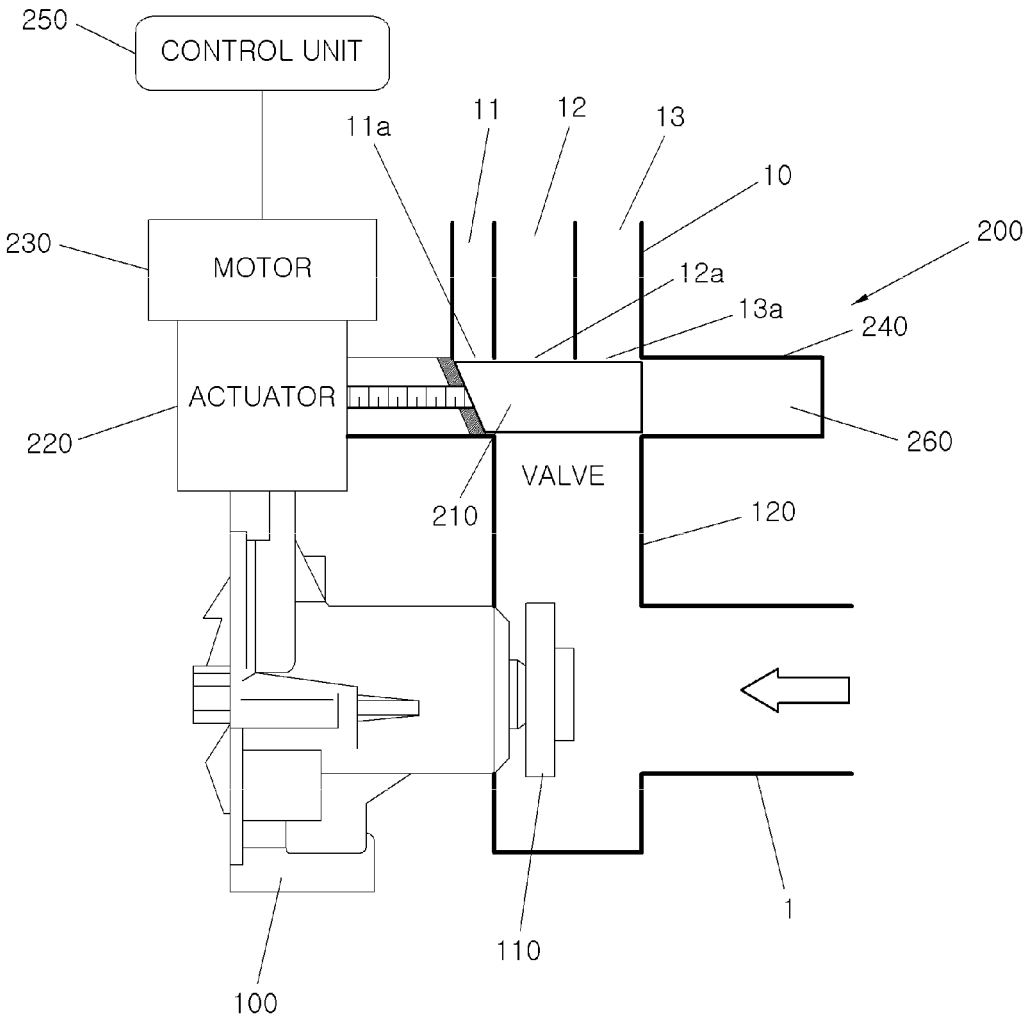
FIG. 1 is a diagram illustrating an engine cooling system according to an embodiment of the present disclosure.

Embodiments of the present disclosure are described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those having ordinary skill in the art. Throughout the disclosure, like reference numerals refer to like parts throughout the various figures and embodiments of the present disclosure.

FIG. 1 is a diagram illustrating an engine cooling system according to an embodiment of the present disclosure.

As illustrated in FIG. 1, the engine cooling system according to the present disclosure includes a water pump 100, a coolant passage 10 having a plurality of passages 11, 12, and 13, and a solenoid valve 200.

The water pump 100 functions to discharge coolant from a coolant storage tank 500 through an inlet 1 by rotating an impeller 110 and to supply the coolant to an engine 300 (see FIG. 2A) and each constituent component of an engine system through an outlet 120. As the water pump 100, a mechanical water pump may be used that rotates an impeller 110 by the driving force of a conventional engine 300 or an electric water pump may be used that rotates an impeller 110 by the driving force of an electric motor.

The solenoid valve 200 is provided at the outlet 120 of the water pump 100. The solenoid valve 200 functions to distribute the coolant discharged from the outlet 120 of the water pump 100 to a plurality of coolant lines and to control the flow of coolant to each of the coolant lines.

A housing 240 of the solenoid valve 200 is provided with an electric motor 230 controlled by the control duty of an engine control unit (ECU) 250, an actuator 220 for switching the rotary motion of the electric motor 230 to a rectilinear motion, and a spool 210 rectilinearly moved in the width direction of the coolant passage 10 and the outlet 120 of the water pump 100 by the actuator 220.

The spool 210 is moved from its initial position (the position illustrated in FIG. 1) to its maximum opening position (see FIG. 3C) by the actuator 220. A portion of the spool 210 is inserted into a spool hole 260 formed in the housing 240 of the solenoid valve 200 at the maximum opening position as illustrated in FIG. 3C. In order for the spool 210 to simultaneously close inlets 11*a*, 12*a*, and 13*a* of the respective constituent passages 11, 12, and 13 of the coolant passage 10 when the spool 210 is at the initial position, the spool 210 must have a larger width than the sum of the widths of the inlets 11*a*, 12*a*, and 13*a* of the respective passages 11, 12, and 13.

In an example illustrated in FIG. 1, the solenoid valve 200 is installed outside the outlet 120 of the water pump 100. In this case, the conventional mechanical water pump or electronic water pump is intactly usable in connection with the solenoid valve 200, which is advantageous in terms of utilization of existing products. However, the present disclosure is not limited to this embodiment, and the solenoid valve 200 may be integrally formed in the outlet of the water pump 100.

The outlet end of the solenoid valve 200 is provided with the coolant passage 10, including the passages 11, 12, and 13, through which coolant is delivered to each constituent component of the engine system.

Figure 2A:
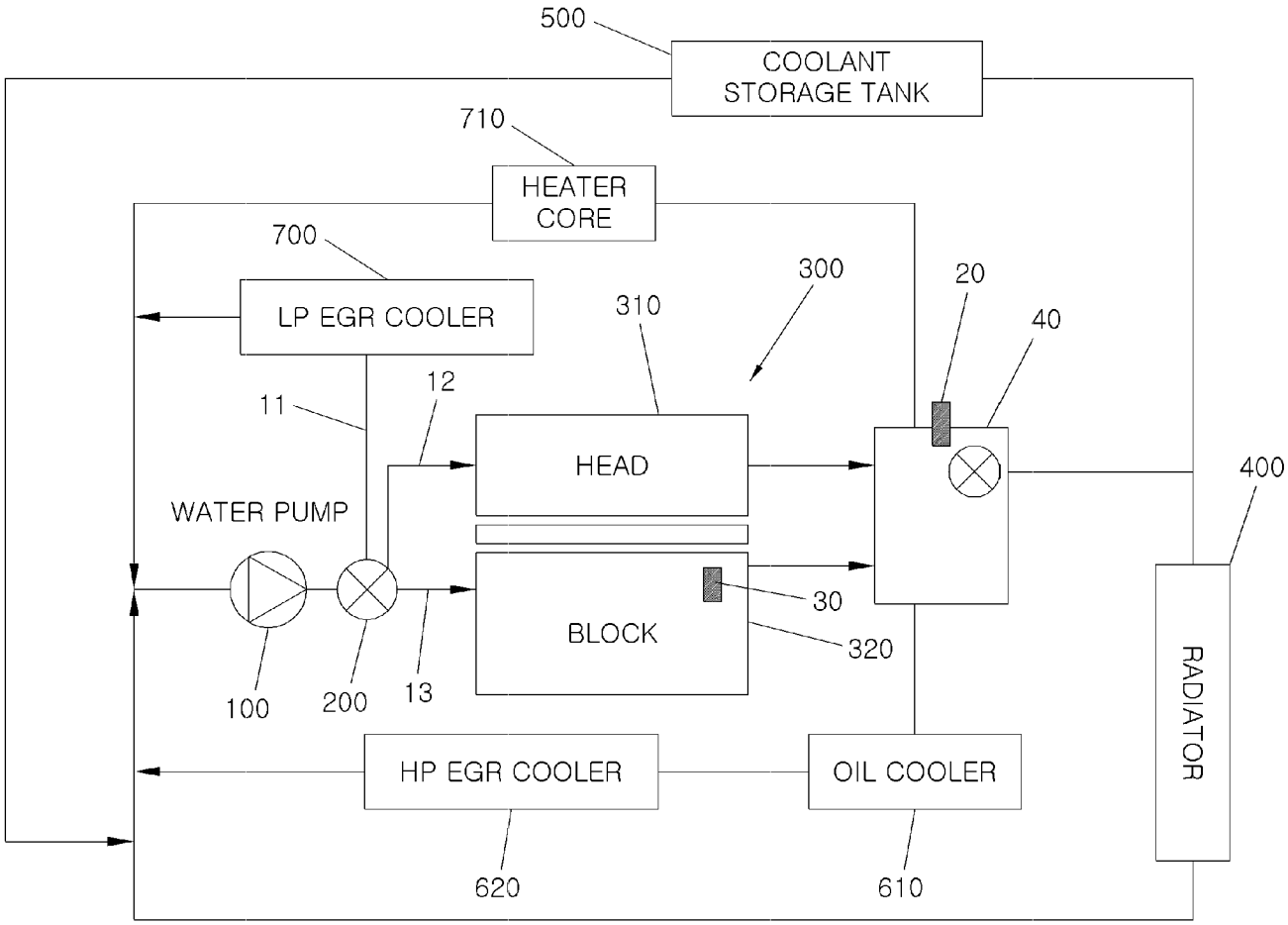
FIGS. 2A and 2B are diagrams illustrating an engine system to which an engine cooling system according to an embodiment of the present disclosure is applied.

Referring to FIGS. 1 and 2A, the coolant passage 10 includes the first passage 11 directed toward an LP EGR cooler 700, the second passage 12 directed toward the cylinder head 310 of the engine 300, and the third passage 13 directed toward the cylinder block 320 of the engine. The inlets 11*a*, 11*b*, and 11*c* of the respective first, second, and third passages 11, 12, and 13 are arranged side by side in the width direction of the coolant passage 10 and the outlet 120 of the water pump 100 when viewed from the side. The inlets 11*a*, 11*b*, and 11*c* of the respective passages 11, 12, and 13 may be formed by partitioning the internal space of a single integrated tube by partition walls. The passages 11, 12, and 13 have different widths or sizes depending on the flow of coolant required to cool each component. With respect to the total discharge amount of coolant from the water pump 100, in one embodiment the width of the second passage 12 is set such that the amount of the coolant toward the cylinder head 310 required for a large amount of coolant is 65%, the width of the third passage 13 is set such that the amount of the coolant toward the cylinder block 320 is 35%, and the width of the first passage 11 is set such that the remaining amount of the coolant toward the LP EGR cooler is 15%.

Figure 2B:
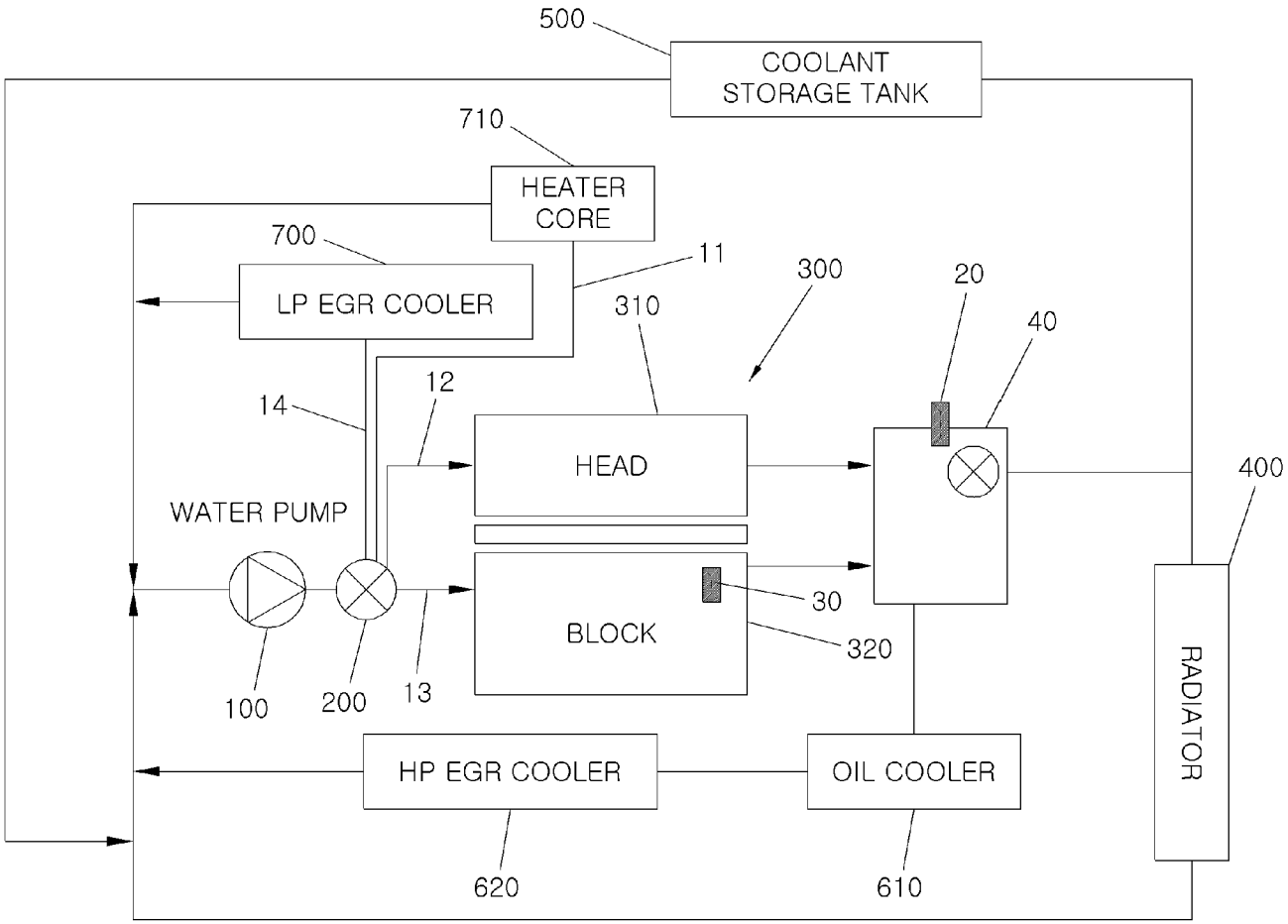

Although the coolant passage 10 is illustrated as having three combined passages 11, 12, and 13 directed toward the LP EGR cooler 700 and the cylinder head 310 and cylinder block 320 of the engine 300 in FIGS. 1 and 2A, the present disclosure is not limited thereto. The coolant passage 10 may have various numbers of passages depending on the number of branched passages and components to be cooled. For example, as illustrated in FIG. 2B, the first passage 11 may be directed to a heater core 710 instead of the LP EGR cooler 700. An additional fourth passage 14 directed to a high-pressure exhaust gas recirculation (HP EGR) cooler 620 may also be formed adjacent to the first passage 11 of the coolant passage 10.

However, a passage through which coolant is first supplied according to the temperature of the coolant, as described below, must be disposed closest to the initial position of the spool 120. Passages must also be arranged side by side in order of supply of coolant according to the temperature of the coolant.

Figure 3A:
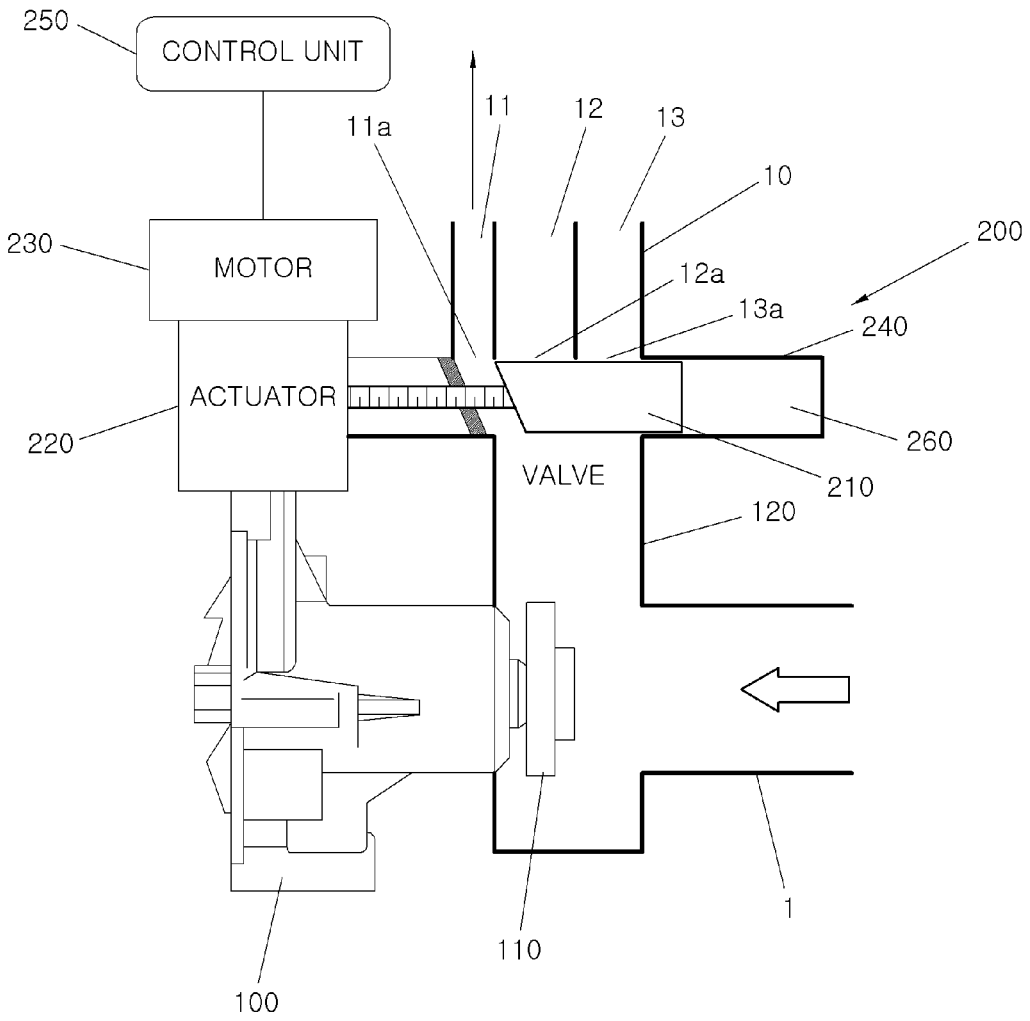
FIGS. 3A-3C are diagrams for explaining a method of controlling and distributing a discharge flow rate of a water pump 100 according to the operation of a solenoid valve 200 in an engine cooling system according to an embodiment of the present disclosure.
Figure 3B:
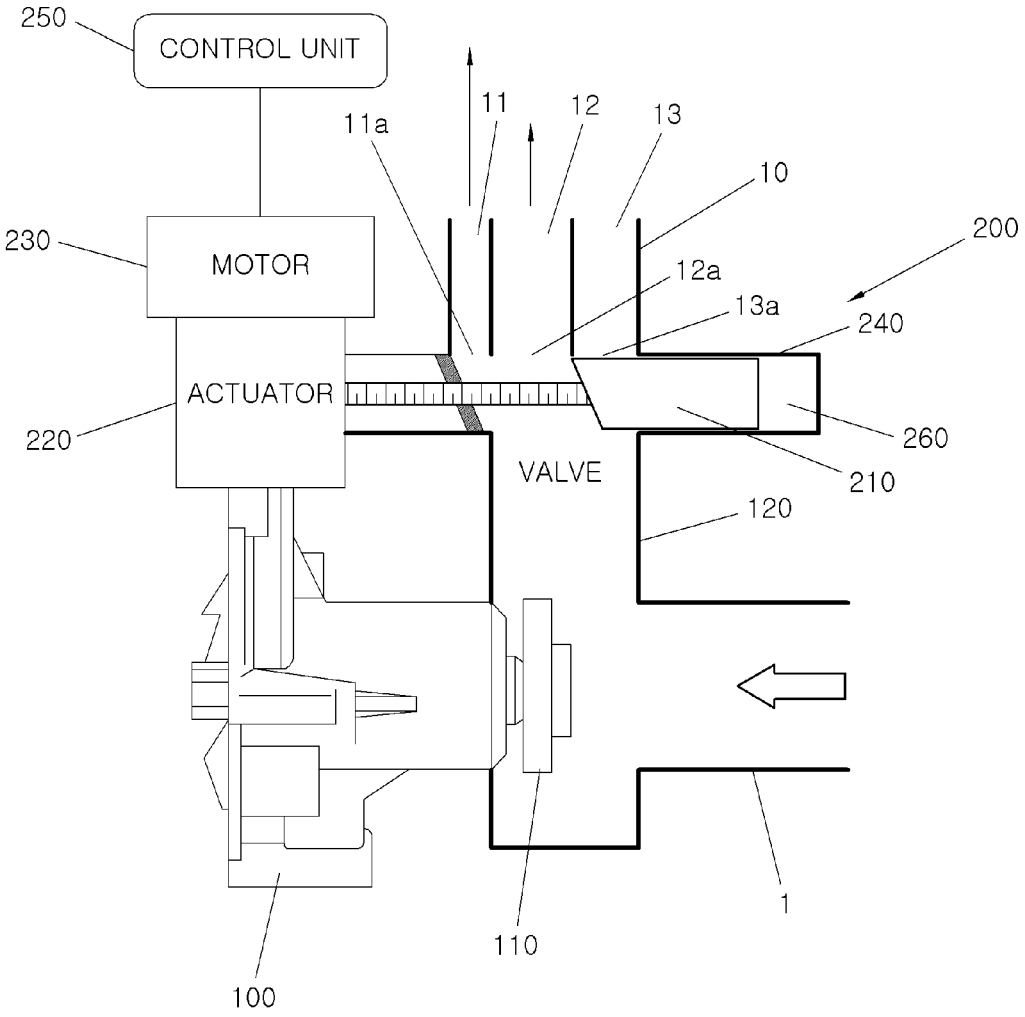
Figure 3C:
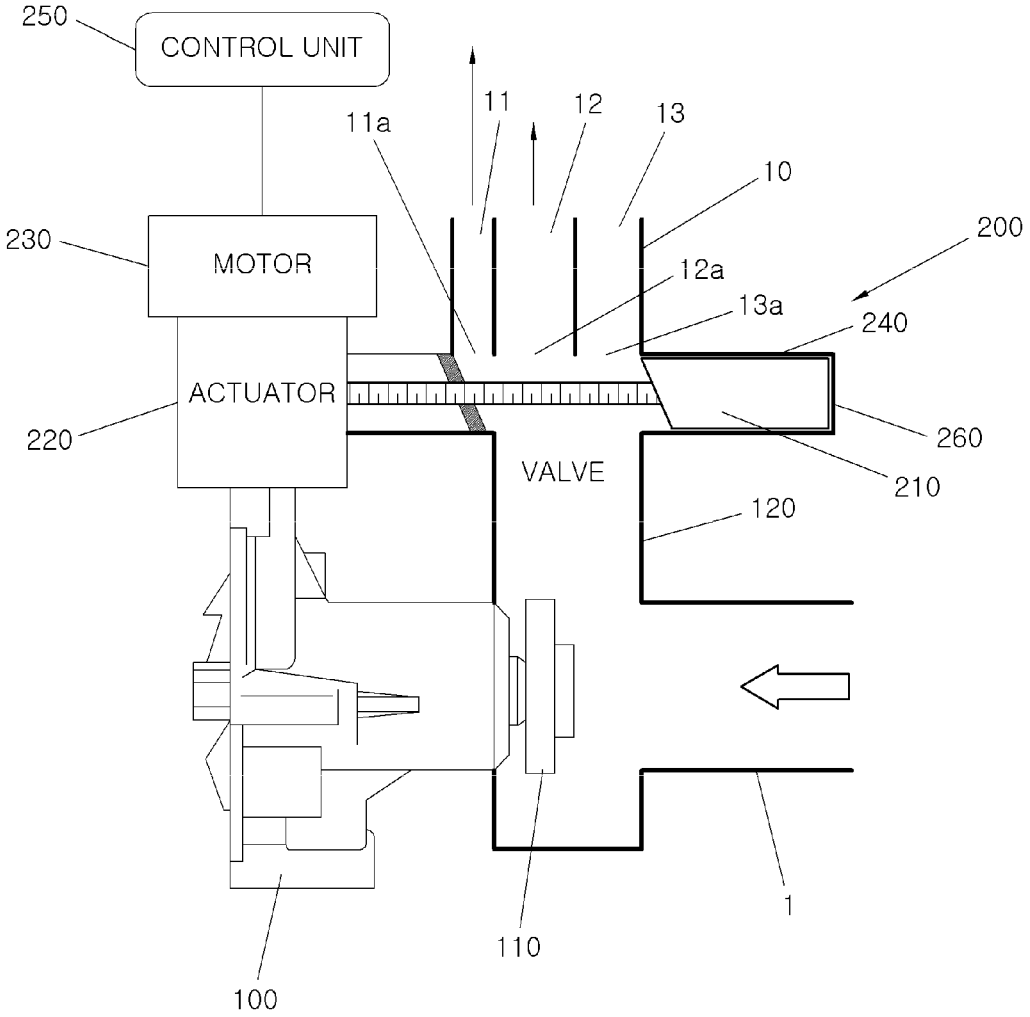

FIGS. 3A-3C are diagrams for explaining a method of controlling and distributing a discharge flow rate of the water pump 100 according to the operation of the solenoid valve 200 in the engine cooling system of the present disclosure.

As described above, the width of the spool 210 is larger than the sum of the widths of the inlets 11*a*, 12*a*, and 13*a* of the respective passages 11, 12, and 13. Thus, in the state of FIG. 1 in which the spool 210 is at the initial position, the inlets 11*a*, 12*a*, and 13*a* of the respective constituent passages 11, 12, and 13 of the coolant passage 10 are simultaneously closed by the spool 210.

As illustrated in FIG. 3A, when the motor 230 begins to rotate by the control of the ECU 250, the spool 210 is rectilinearly moved by a predetermined distance from the initial position of the spool 210 to the left in the drawing by the operation of the actuator 220. Thus, the first passage 11 disposed at the leftmost position in the drawing is first opened. FIG. 3A illustrates a state in which the solenoid valve 200 is controlled to open only the first passage 11. In this state, coolant flows only to the LP EGR cooler 700 connected to the first passage 11. The flow of coolant to the first passage 11 may be regulated by controlling the degree of opening of the inlet 11*a* of the first passage 11 with the solenoid valve 200 according to the driving state of the engine or the external environment.

When the motor 230 further rotates by the control of the ECU 250, the spool 210 is further rectilinearly moved by a predetermined distance from the position illustrated in FIG. 3A to the left in the drawing by the operation of the actuator 220. Thus, the second passage 12 adjacent to the first passage 11 is opened. FIG. 3B illustrates a state in which the solenoid valve 200 is controlled to open the inlets 11*a* and 12*a* of the first and second passages 11 and 12. In this state, coolant flows to the LP EGR cooler 700 connected to the first passage 11 and the cylinder head 310 of the engine 300 connected to the second passage 12. In this state, the flow of coolant to the second passage 12 may be regulated by controlling the degree of opening of the inlet 12*a* of the second passage 12 with the solenoid valve 200 according to the driving state of the engine or the external environment.

When the motor 230 further rotates by the control of the ECU 250, the spool 210 is further rectilinearly moved by a predetermined distance from the position illustrated in FIG. 3B to the right in the drawing by the operation of the actuator 220. Thus, the third passage 13 adjacent to the second passage 12 is finally opened. In the state illustrated in FIG. 3C, coolant flows to the LP EGR cooler 700 connected to the first passage 11, the cylinder head 310 of the engine 300 connected to the second passage 12, and the cylinder block 320 connected to the third passage 13. In this state, the flow of coolant to the third passage 13 may be regulated by controlling the degree of opening of the inlet 13*a* of the third passage 13 with the solenoid valve 200 according to the driving state of the engine or the external environment. For example, when the spool 210 is at the maximum opening position illustrated in FIG. 3C, the flow of coolant to the third passage 13 is maximum.

As described below, coolant must be supplied to the LP EGR cooler 700 or the heater core 710, from among the components of the engine system, from when the engine is operated in a warm state. It is necessary to supply coolant to the cylinder block 320 when the engine is overheated so that the temperature of the coolant is high. Accordingly, the opening timing of each passage and the flow of coolant to each passage can be controlled by an integrated and simple method of merely arranging three passages 11, 12, and 13, which are directed to the LP EGR cooler 700 and the cylinder head 310 and cylinder block 320 of the engine 300, in the movement direction of the spool 210 of the solenoid valve 200 and controlling the rectilinear movement of the spool 210 as described above.

FIGS. 2A and 2B are diagrams illustrating the engine system to which the engine cooling system according to an embodiment of the present disclosure is applied.

The engine system, which includes an engine 300, a radiator 400, a coolant storage tank 500, an oil cooler 610, an HP EGR cooler 620, an LP EGR cooler 700, and a heater core 710, is cooled by the engine cooling system.

In the engine system illustrated in FIG. 2A, the coolant stored in the coolant storage tank 500 is pumped by the water pump 100 and flows to the LP EGR cooler 700 and the cylinder head 310 and cylinder block 320 of the engine 300 through first, second, and third passages 11, 12, and 13, respectively, by the control of the solenoid valve 200. The coolant introduced into the cylinder head 310 and cylinder block 320 of the engine 300 to cool the engine 300 is selectively supplied to the radiator 400, the oil cooler 610, and the heater core 710 through a flow control valve 40 such as a thermostat. The cylinder block 320 comprises a temperature sensor 30 and the flow control valve 40 comprises a temperature sensor 20 for measuring the temperature of cooling water or coolant.

Unlike the embodiment illustrated in FIG. 2A, in the engine system illustrated in FIG. 2B, the coolant supplied through the first passage 11 is supplied to the heater core 710 and supplied to the radiator through the fourth passage 14 additionally formed in the coolant passage 10.

Here, the oil cooler 610 functions to cool or heat oil by the coolant supplied thereto, and the heater core 710 functions to heat the air inside the vehicle interior by the coolant supplied thereto. The radiator 400 functions to discharge the heat of hot coolant to the outside. The LP EGR cooler 700 and the HP EGR cooler 620 function to cool LP EGR gas and HP EGR gas, respectively, before the gases are supplied to the intake system of the engine 300.

FIGS. 4A-4E are diagrams illustrating a flow of coolant according to the temperature of coolant in the engine cooling system of the present disclosure illustrated in FIG. 2A. The bold line in the drawing refers to a portion in which coolant flows.

Figure 4A:
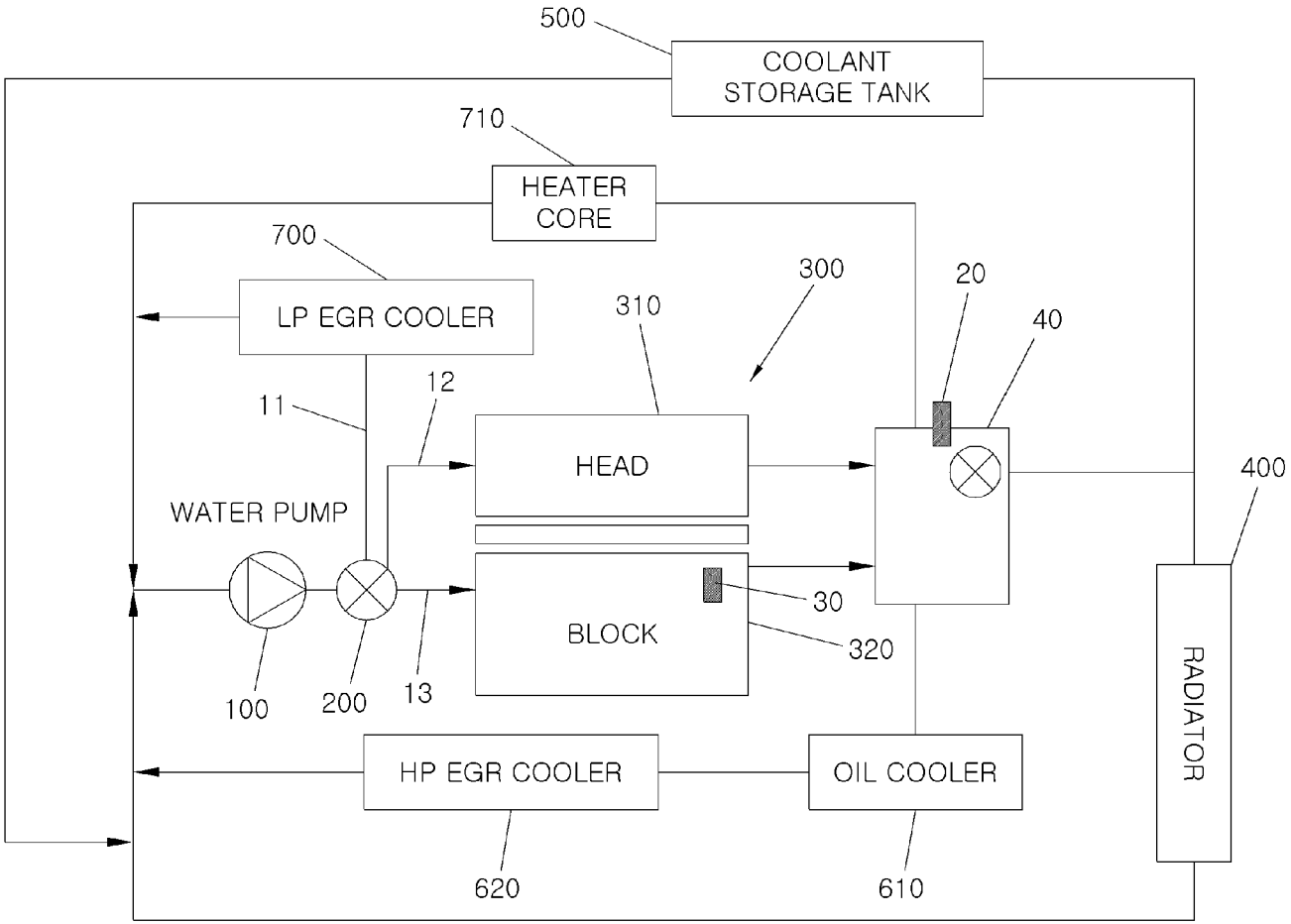
FIGS. 4A-4E are diagrams illustrating a flow of coolant according to the temperature of coolant in an engine cooling system according to an embodiment of the present disclosure.

FIG. 4A is a diagram illustrating a flow of coolant when the engine 300 is operated under a cold condition. When the temperature of coolant is less than or equal to a first temperature, namely in the cold state of the engine (e.g., the temperature of coolant is about 50° C. or less), it is necessary to increase the temperature of the coolant as fast as possible by stopping the flow of the coolant for rapid warm-up. Accordingly, the ECU 250 stops the operation of the water pump 100 or controls the solenoid valve 200 to close the entire coolant passage 10 and stop the flow of coolant in the engine system.

Figure 4B:
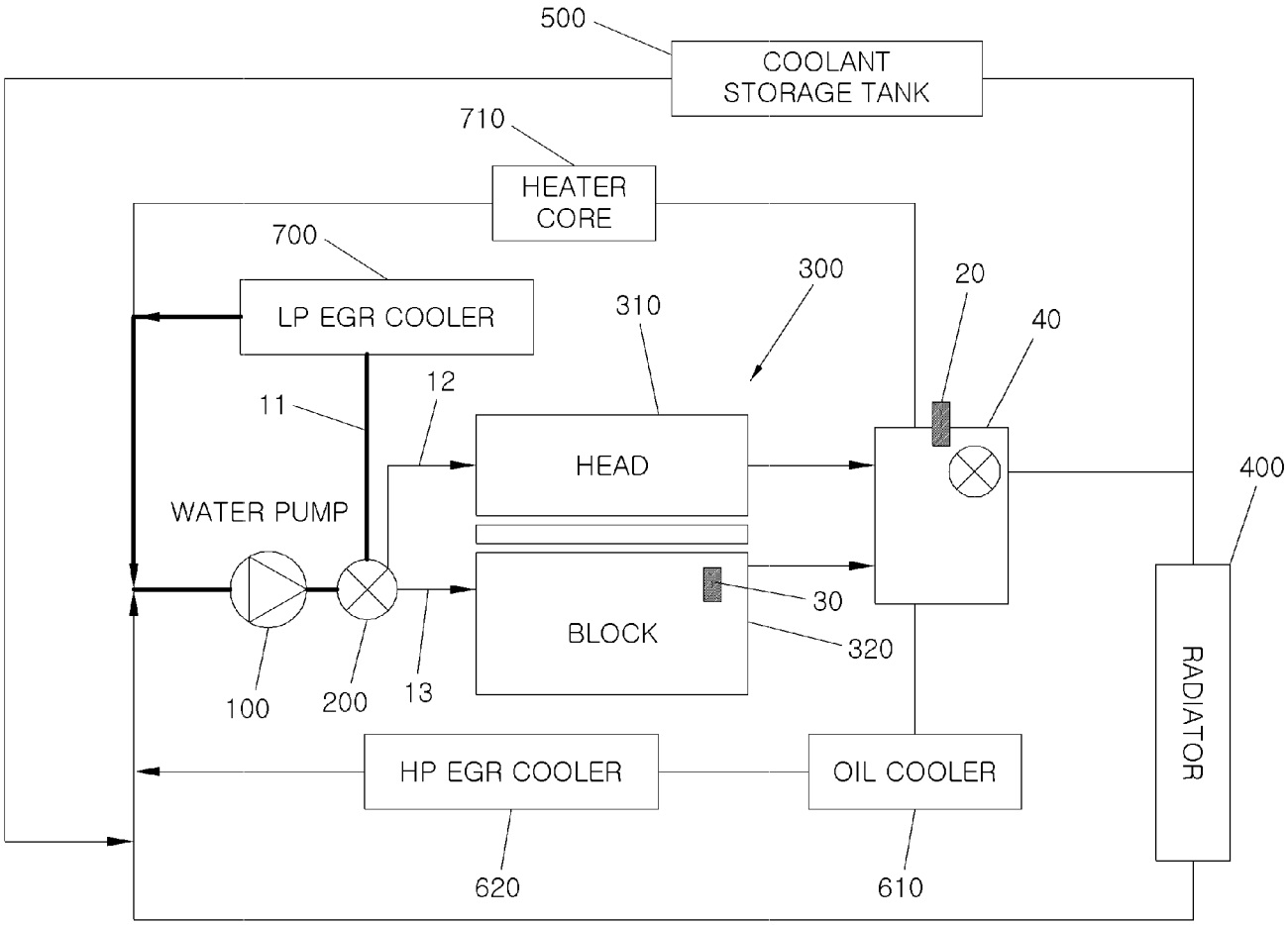

FIG. 4B is a diagram illustrating an example of a flow of coolant when the operating condition of the engine is changed from a cold condition to a warm condition. This is a state in which the temperature of coolant exceeds a first temperature and is less than or equal to a second temperature (e.g., higher than 50° C. and less than or equal to 90° C.). In this state, it is necessary to recover exhaust heat by sending coolant to the LP EGR cooler 700, but it is necessary to block supply of coolant to the cylinder head 310 and cylinder block 320 of the engine 300 for rapid warm-up of the engine 300. Accordingly, the ECU 250 controls the solenoid valve 200 to be in the state illustrated in FIG. 3A. That is, the solenoid valve 200 is controlled such that the spool 210 is positioned at a position where the first passage 11 is opened and the second and third passages 12 and 13 are closed. As a result, it is possible to reduce friction and improve fuel efficiency when the engine 300 warms up.

When the temperature of coolant is in a warm state, the heater core 710 is in an operable state. In this case, coolant, the temperature of which is increased, is supplied to the heater core 710 for an improvement in heating performance and fuel efficiency. When the temperature of coolant is in the warm state, the temperature of oil is relatively low. In this case, the temperature of coolant is increased and the coolant is supplied to the oil cooler 610 in order to reduce the friction in the engine and improve fuel efficiency and engine performance.

Figure 4C:
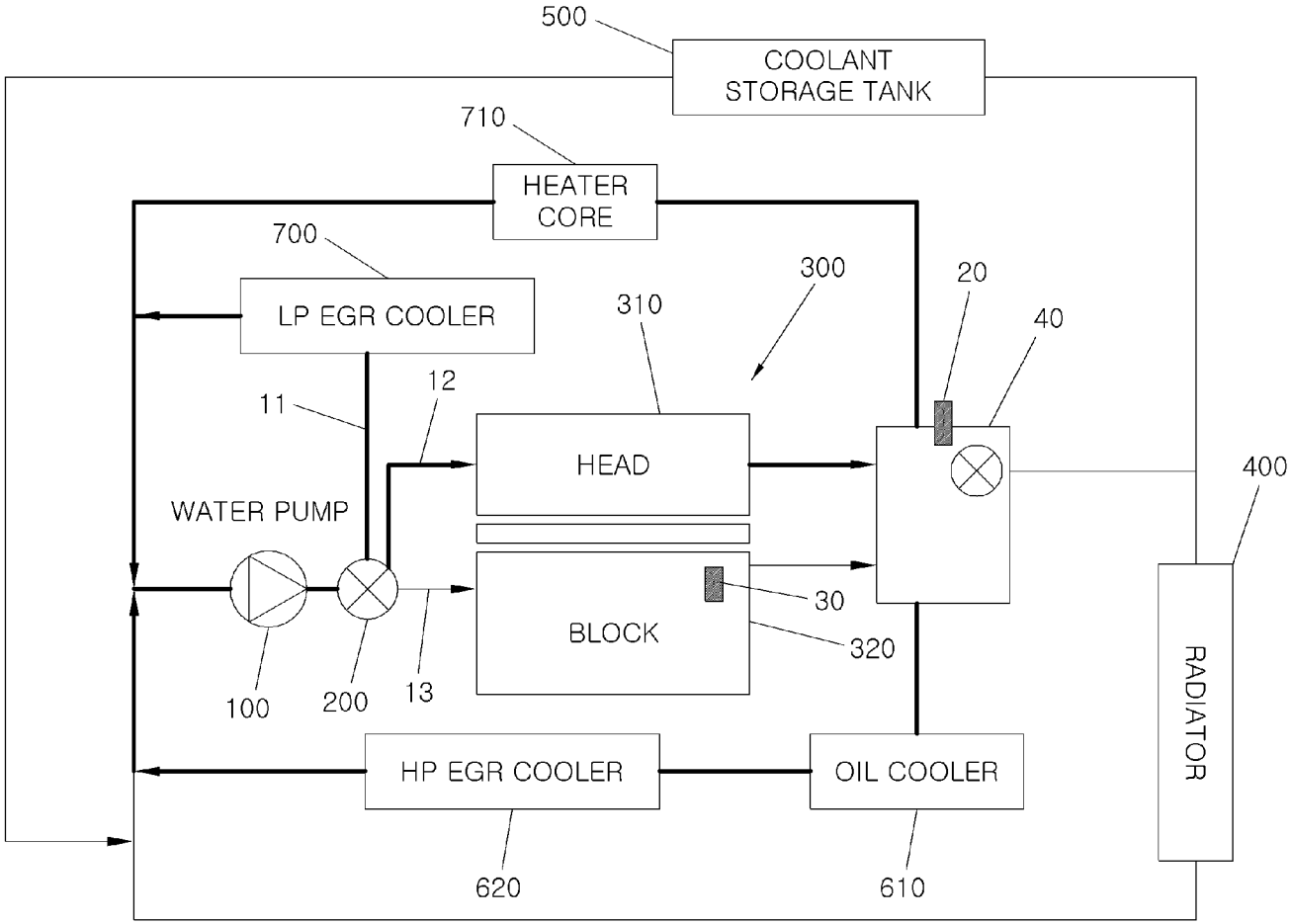

Therefore, as illustrated in FIG. 4C, coolant is delivered even to the oil cooler 610 and the heater core 710 using the separate flow control valve 40, such as a thermostat, when the operating condition of the engine is changed from the cold condition to the warm condition. If one of the constituent passages of the coolant passage 10 is connected to the heater core 710 as illustrated in FIG. 2B, it is possible to supply coolant to the heater core 710 by controlling the solenoid valve 200.

According to the driving state of the engine and the external environment, the solenoid valve 200 is controlled such that coolant flows to the cylinder head 310 under the warm condition as illustrated in FIG. 4C. That is, the solenoid valve 200 is controlled such that the spool 210 is at a position where the first and second passages 11 and 12 are opened and the third passage 13 is closed. As a result, it is possible to effectively cool the engine 300.

Figure 4D:
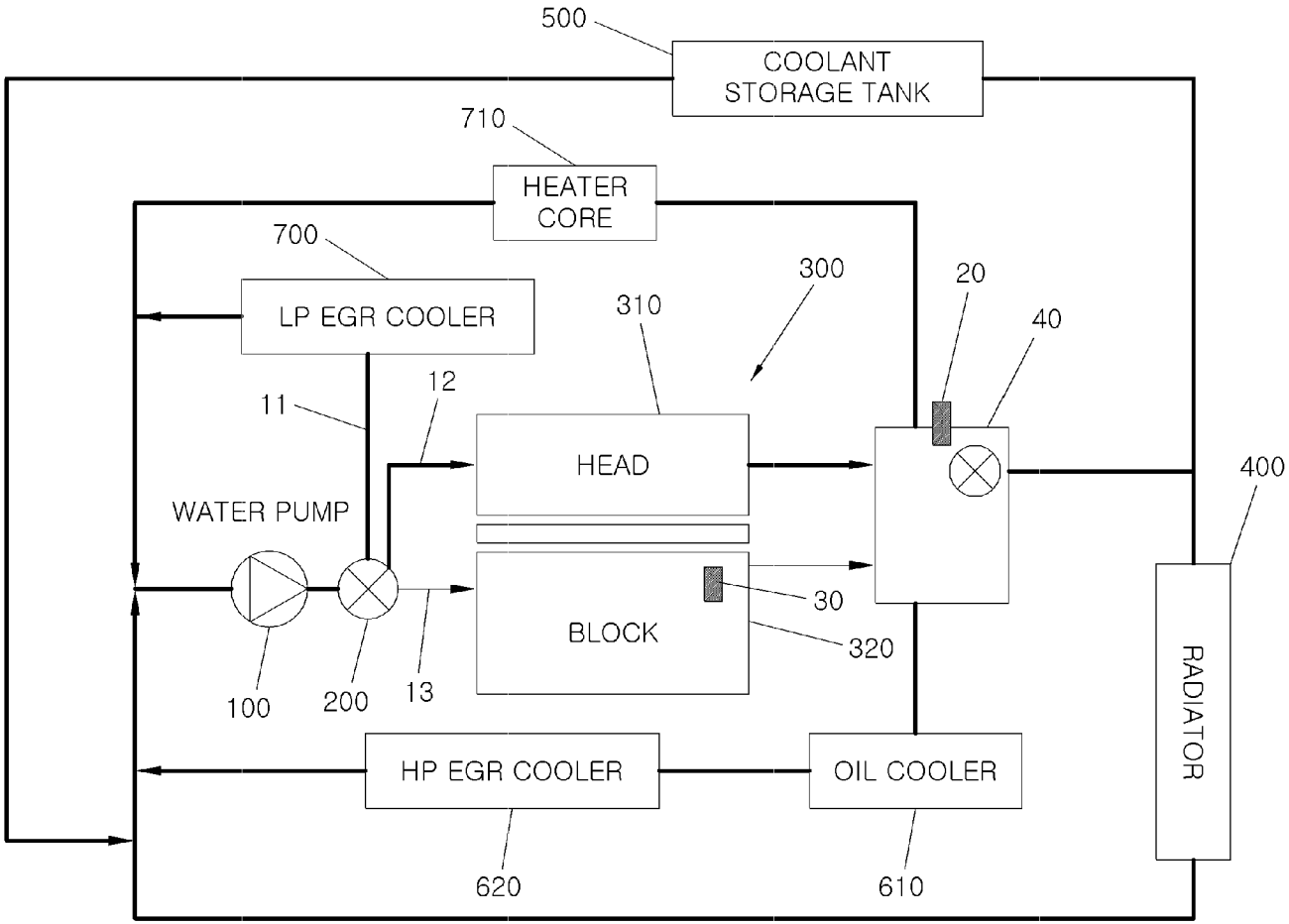

FIG. 4D is a diagram illustrating an example of a flow of coolant when the operating condition of the engine is changed from a warm condition to a high-temperature condition. This is a state in which the temperature of coolant exceeds a second temperature and is less than or equal to a third temperature (e.g., higher than 90° C. and less than or equal to 105° C.). In this state, the ECU 250 controls the solenoid valve 200 to rapidly cool coolant by supplying the coolant to the radiator 400 through the flow control valve 40 while supplying a large amount of coolant to the cylinder head 310. That is, the solenoid valve 200 is controlled such that the spool 210 is at a position where the inlet 12*a* of the second passage 12 is further opened.

Figure 4E:
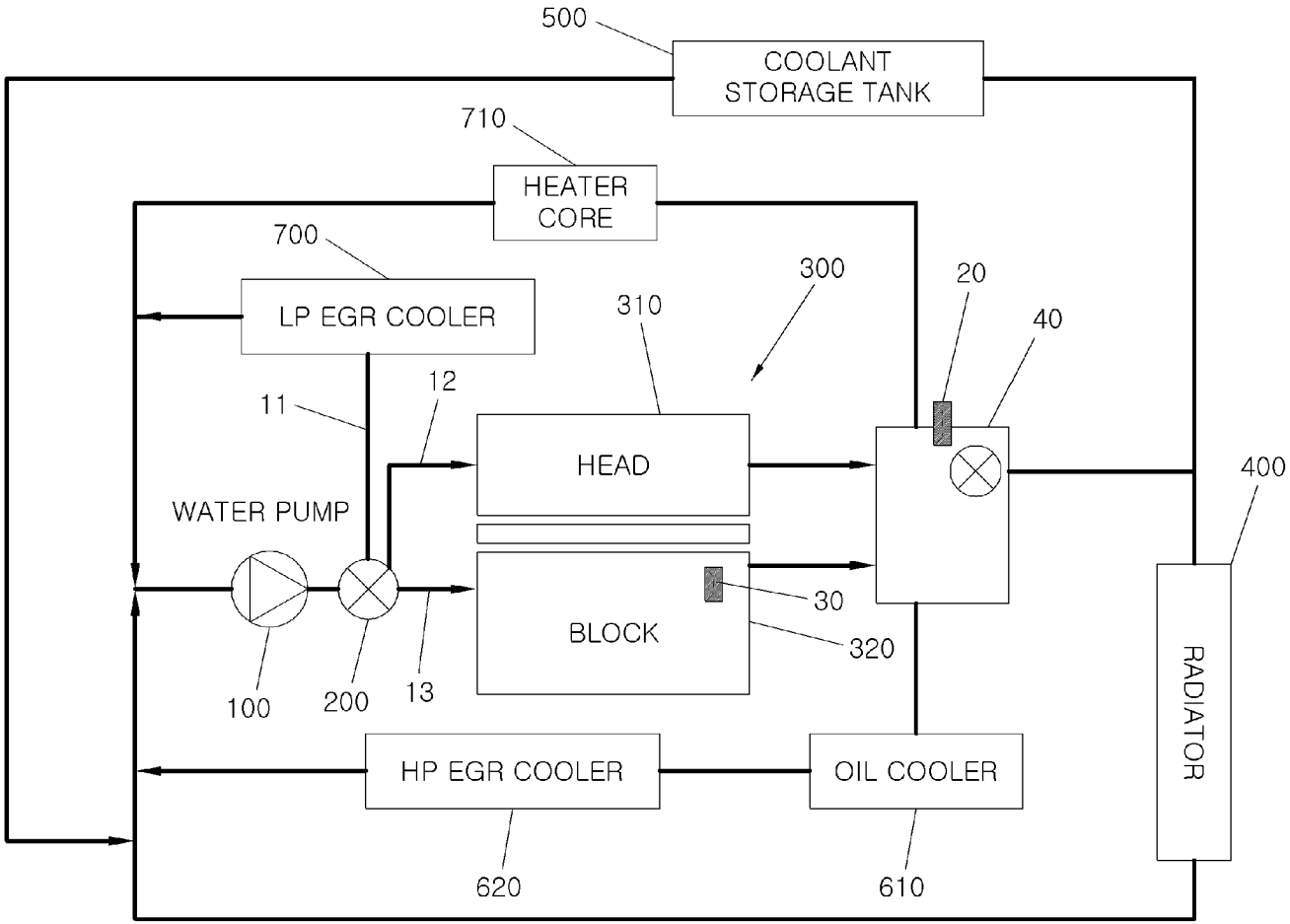
Figure 5A:
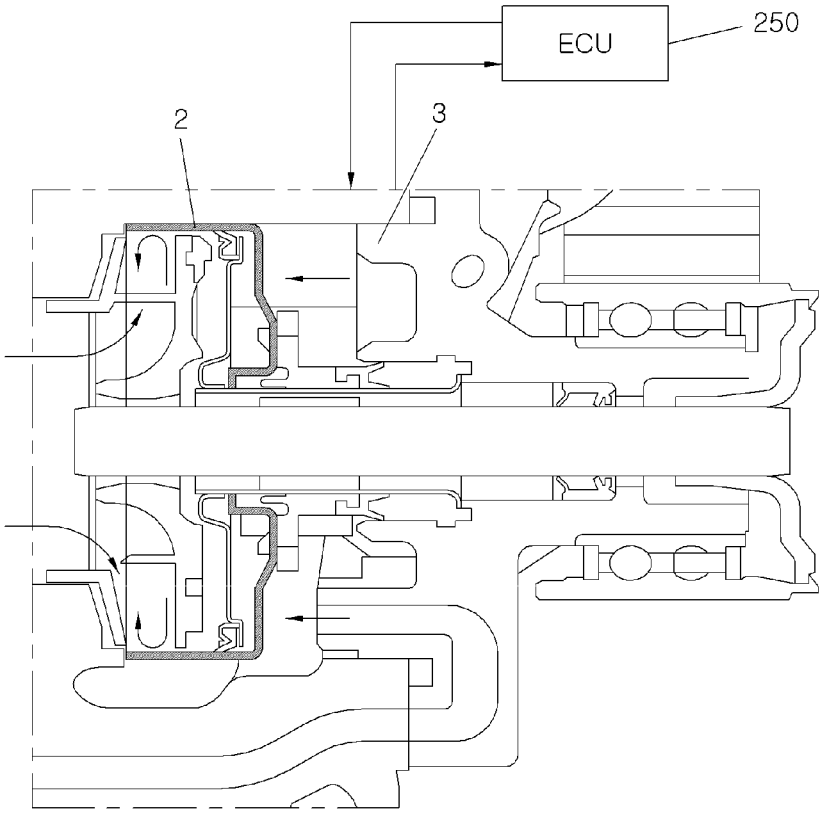
FIG.5A (Prior Art)
FIGS. 5A and 5B are views for explaining the operation of a conventional electronically variable water pump.
Figure 5B:
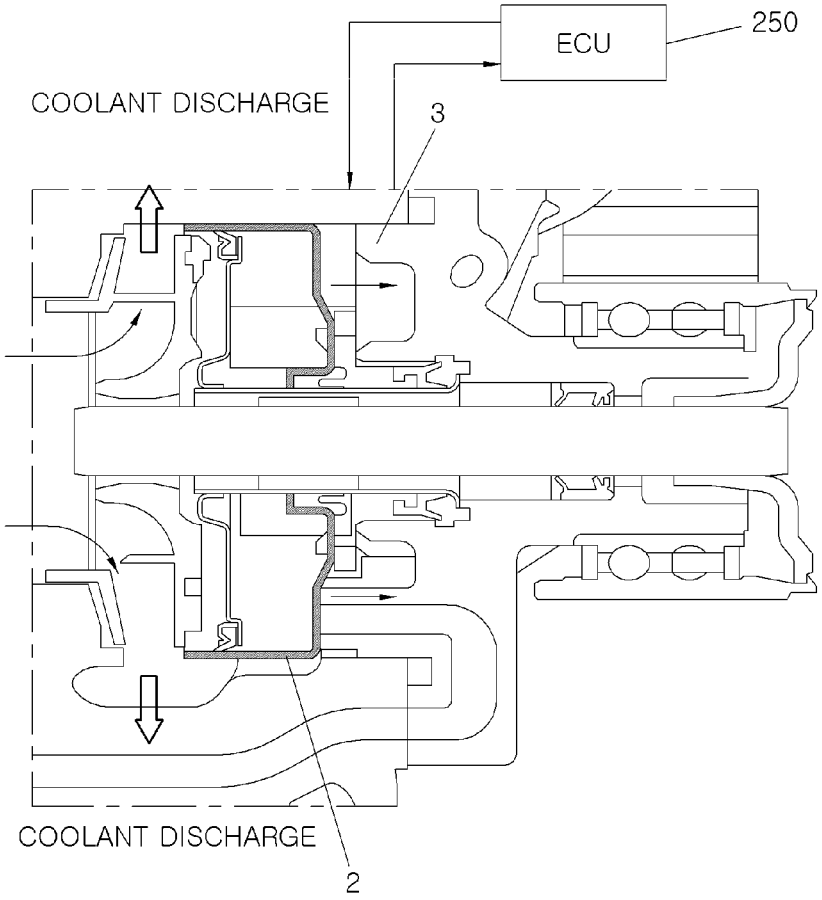
FIG.5B (Prior Art)
Figure 6:
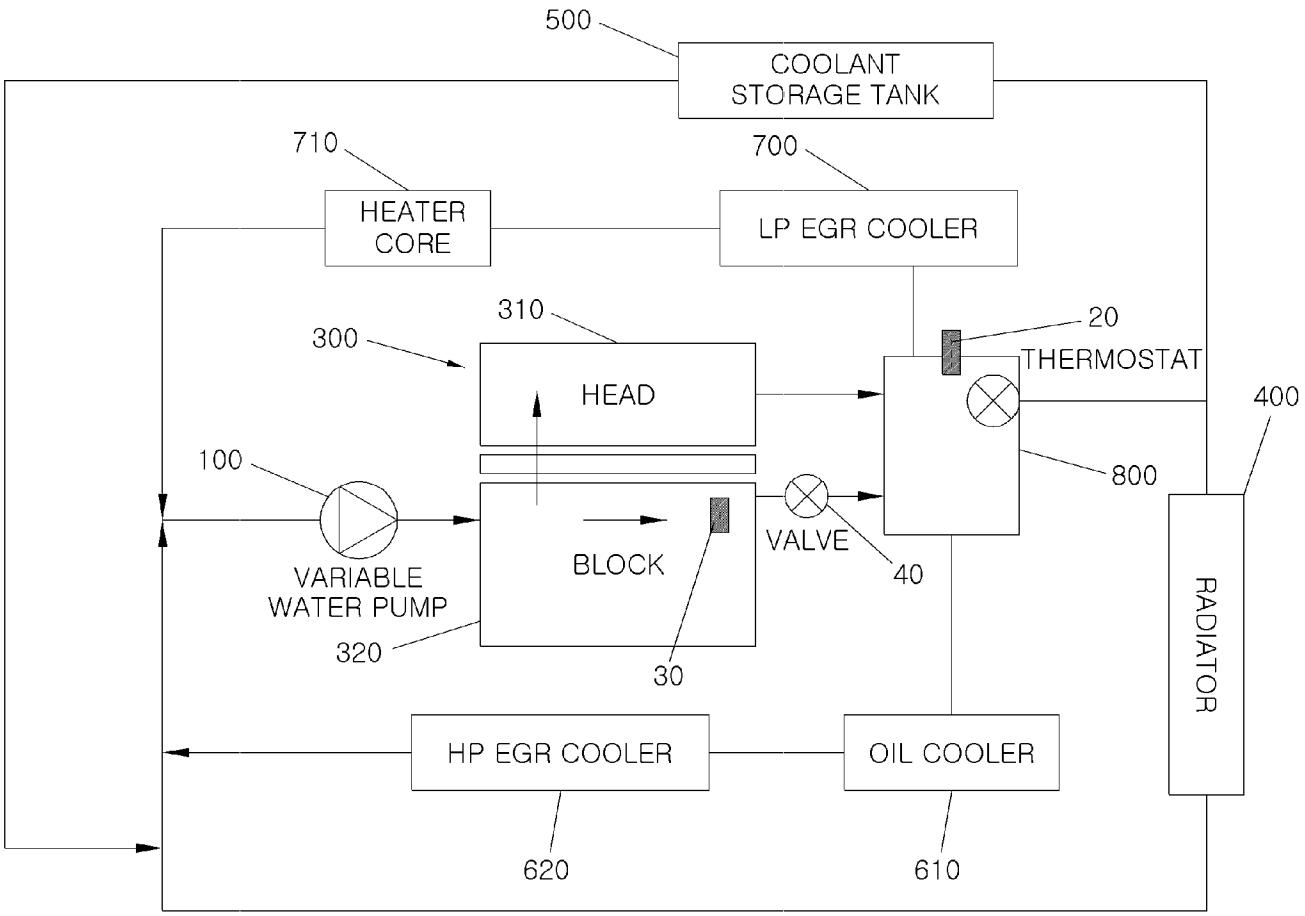
FIG.6 (Prior Art)
FIG. 6 is a diagram illustrating an engine cooling system to which the conventional electronically variable water pump is applied.

FIG. 4E is a diagram illustrating an example of a flow of coolant when the operating condition of the engine is changed from a high-temperature condition to a hot condition. This is a state in which the temperature of coolant exceeds a third temperature (e.g., higher than 105° C.). When the temperature of coolant is in the hot state higher than that in FIG. 4D, the ECU 250 controls the solenoid valve 200 to supply a large amount of coolant even to the cylinder block 320. That is, the solenoid valve 200 is controlled such that the spool 210 is at a position where the inlet 13*a* of the third passage 13 is opened as illustrated in FIG. 3C.

In the engine cooling system according to the present disclosure, it is possible to separately cool the cylinder head and cylinder block of the engine through simpler structure and control and to integrally control the flow distribution to the LP EGR cooler, the heater cooler, or the oil cooler.

In accordance with the engine cooling system of the present disclosure, it is possible to variably control the outlet flow rate of the water pump through simple structure and control compared to the electronically variable water pump. Therefore, it is advantageous in terms of durability and manufacturing costs.

In addition, the present disclosure can simultaneously control and distribute the outlet flow rate of the water pump, unlike the electronically variable water pump, thereby achieving a reduction in fuel efficiency and an improvement in performance.

In addition, it is possible to separately cool the cylinder head and cylinder block of the engine through simpler structure and control and to integrally control the flow distribution to the LP EGR cooler, the heater cooler, or the oil cooler.

In addition, since the solenoid valve is provided outside the body of the water pump to control and distribute the flow of coolant, the conventional water pump can be applied as-is and it is also possible to use the mechanical water pump as well as the electronically variable water pump.

While the present disclosure has been described with respect to the specific embodiments, it will be apparent to those having ordinary skill in the art that various changes and modifications may be made without departing from the spirit and scope of the disclosure as defined in the following claims.

What is claimed is:

1. An engine cooling system comprising:

a water pump for supplying coolant to an engine system;

a plurality of coolant passages for connecting the water pump to individual constituent components of the engine system;

a solenoid valve disposed between an outlet of the water pump and inlets of the plurality of coolant passages to integrally control a flow of coolant from the water pump to the plurality of coolant passages; and a control unit for controlling the solenoid valve, wherein the inlets of the respective plurality of coolant passages are adjacent to each other side by side in a width direction of the outlet of the water pump, and the inlets of the respective plurality of coolant passages are sequentially opened and closed by moving a spool of the solenoid valve in the width direction.

2. The engine cooling system of claim 1, wherein the plurality of coolant passages have different widths depending on the flow of coolant required to cool each component.

3. The engine cooling system of claim 2, wherein:

the plurality of coolant passages comprise a first passage directed to a heater core or an LP EGR cooler, a second passage directed to a cylinder head of an engine, and a third passage directed to a cylinder block of the engine; and the inlets of the respective first, second, and third passages are arranged so as to be opened in order of the first, second, and third passages when the spool moves in the width direction.

4. The engine cooling system of claim 3, wherein the widths of the first, second, and third passages are set such that the largest amount of coolant flows to the cylinder head of the engine and the smallest amount of coolant flows to the heater core or the LP EGR cooler.

5. The engine cooling system of claim 3, wherein, when the engine is in a cold state in which the temperature of coolant is less than or equal to a first temperature, the control unit controls the solenoid valve to stop the operation of the water pump or close all the first, second, and third passages, thereby stopping the flow of coolant in the engine system.

6. The engine cooling system of claim 5, wherein, when the engine is in a warm state in which the temperature of coolant exceeds the first temperature and is less than or equal to a second temperature, the control unit controls the solenoid valve to open the first passage.

7. The engine cooling system of claim 6, wherein, when the engine is in a high-temperature state in which the temperature of coolant exceeds the second temperature and is less than or equal to a third temperature, the control unit controls the solenoid valve to open the first and second passages.

8. The engine cooling system of claim 7, wherein, when the engine is in a hot state in which the temperature of coolant exceeds the third temperature, the control unit controls the solenoid valve to open all the first, second, and third passages.

9. The engine cooling system of claim 6, wherein:

the first passage is a coolant passage directed to the LP EGR cooler; and the engine cooling system further comprises a flow control valve for opening and closing a coolant passage through which some of the coolant heated through the engine flows to the heater core.

10. The engine cooling system of claim 9, wherein, when the temperature of coolant exceeds the first temperature and is less than or equal to the second temperature, the control unit controls the flow control valve such that some of the coolant heated through the engine flows to the heater core.

11. The engine cooling system of claim 1, wherein the water pump is a mechanical water pump.

12. The engine cooling system of claim 1, wherein the water pump is an electronically variable water pump.

13. The engine cooling system of claim 1, wherein the solenoid valve is built in the outlet of the water pump.

* * * * *